US006164470A

United States Patent [19]

Chino

[11] Patent Number: 6,164,470

[45] Date of Patent: Dec. 26, 2000

[54] HERMETIC SEAL AND WIDE-MOUTHED BOTTLE SEALED BY THE SEAL

[75] Inventor: Hiroshi Chino, Nagano-Ken, Japan

[73] Assignee: A. K. Technical Laboratory, Inc., Nagano-ken, Rep. of Korea

[21] Appl. No.: 09/254,788

[22] PCT Filed: Jul. 10, 1998

[86] PCT No.: PCT/JP98/03092

§ 371 Date: May 11, 1998

§ 102(e) Date: May 11, 1998

[87] PCT Pub. No.: WO99/02418

PCT Pub. Date: Jan. 21, 1999

[30] Foreign Application Priority Data

Jul. 11, 1997 [JP] Japan ..... 9-186728

[51] Int. Cl.[7] ..... B65D 39/00

[52] U.S. Cl. ..... 215/232; 215/270; 215/276

[58] Field of Search ..... 215/230, 232, 215/270, 276

[56] References Cited

U.S. PATENT DOCUMENTS

| | | | |
|---|---|---|---|
| 2,040,798 | 5/1936 | Schoonmaker | 215/270 X |
| 2,449,014 | 9/1948 | Shaffer | 215/276 X |
| 4,122,964 | 10/1978 | Morris | 215/260 |
| 4,408,694 | 10/1983 | Mueller | 215/276 |
| 4,533,059 | 8/1985 | Kapolas et al. | 215/230 |
| 4,721,219 | 1/1988 | Dullabaun et al. | 215/274 |
| 5,119,962 | 6/1992 | Vercillo et al. | 215/230 |

FOREIGN PATENT DOCUMENTS

| | | |
|---|---|---|
| 59-78246 | 5/1984 | Japan . |
| 8-295354 | 11/1996 | Japan . |

*Primary Examiner*—Stephen K. Cronin
*Attorney, Agent, or Firm*—J. C. Patents; Jiawei Huang

[57] ABSTRACT

A hermetic seal for sealing a mouth of a wide-mouthed bottle having a body portion thinly formed by stretch blow molding, and a wide-mouthed bottle a mouth of which is sealed by the hermetic seal. A synthetic resin laminated sheet comprising an aluminum sheet or an aluminum foil as a base is punched into the same shape as a mouth of the wide-mouthed bottle to form the hermetic seal. The sheet is formed into a flat peripheral portion and a bellows inside the flat portion to have alternate multiple mountain and valley portions by press molding concurrently with the punching. The bellows is formed in a concentrical state or in a spiral state to prevent the deformation of the body portion caused by a reduced pressure inside the bottle resulting from cooling

13 Claims, 2 Drawing Sheets

HERMETIC SEAL AND WIDE-MOUTHED BOTTLE SEALED BY THE SEAL

TECHNICAL FIELD

The present invention relates to a hermetic seal and a wide-mouthed bottle sealed by the seal and more particularly to a seal for sealing a mouth of a synthetic resin wide-mouthed bottle having a body portion thinly formed by stretch blow molding and a wide-mouthed bottle sealed by the seal.

BACKGROUND ART

Bottles and wide-mouthed bottles, which are formed by stretch blow molding of injection molded preform, have a thinly formed body portion with a thickness of about 0.3 mm. Because of it, if a mouth of the bottle is sealed by a cap immediately after the bottle is filled with heated contents, the body portion is pulled inside and deformed resulting from a reduced pressure inside the bottle by cooling.

This deformation tends to appear intensively in the thinnest portion resulting from a difference in a thickness distribution of the bottle body portion, and the appearance of the bottle is extremely impaired. In the bottle and the wide-mouthed bottle having a body portion with a circular shaped horizontal section, in order to solve this problem, the body portion is formed to have a polygonal shaped horizontal section and a body wall portion is formed in panel surfaces which are apt to bend inside. This not only can prevent the partial deformation caused by a reduced pressure, but also can enhance the appearance by bending and deforming the panel surfaces in the body wall portion evenly.

A degree of bending of this panel surface is proportional to an area of the panel surface. In contrast with bottles to store fluids such as drinking water, and juice, however, in wide-mouthed bottles to store contents with viscosity including jam, peanut butter, and honey, the contents are apt to remain in corner portions inside created by the formation of the panel surfaces. As a depth of the corner portions increases, it becomes more difficult to take out the contents with a spoon and the like. In addition, a label will be affixed around the body portion. For a number of reasons including them, an area allowed to form a panel surface is limited, and thereby new means capable of preventing the deformation caused by a reduced pressure in the body portion, which do not use the panel surfaces, are desired.

DISCLOSURE OF THE INVENTION

The present invention was designed to meet the above mentioned requirements. An object of the invention is to provide a hermetic seal for a wide-mouthed bottle formed by stretch blow molding and a wide-mouthed bottle sealed by the seal, which have a capability of preventing deformation caused by a reduced pressure in a body portion. The capability is provided by making a seal for sealing a mouth of the wide-mouthed bottle stretchable in response to a reduced pressure inside the bottle resulting from cooling of contents.

The present invention for attaining the above mentioned object is characterized by providing a hermetic seal for a wide-mouthed bottle formed by stretch blow molding; the hermetic seal is comprised of a flat peripheral portion and a stretchable portion inside the flat portion. In addition, the stretchable portion formed at this time is formed as bellows with alternate multiple mountain and valley portions formed by bending.

Here, it is preferable that the seal is comprised of a laminated sheet constituted of an aluminum sheet or an aluminum foil as a base, to which a synthetic resin film is laminated.

It is also preferable that the bellows are shaped concentrically or spirally, and that a difference in height between the mountain portion and the valley portion of the bellows is from about 1 mm to about 1.5 mm and an interval between the mountain portion and the valley portion adjacent thereto is from about 4 mm to about 6 mm.

Moreover, this invention is characterized by providing a wide-mouthed bottle, wherein a mouth thereof is sealed by a hermetic seal; a body portion thereof is thinly formed by stretch blow molding; the hermetic seal has a flat peripheral portion and a stretchable bellows inside the flat portion with alternate multiple mountain and valley portions formed by bending, and is formed into the same shape as the mouth of the wide-mouthed bottle; and the mouth is sealed by the seal, while the deformation of the body portion caused by a reduced pressure inside the bottle resulting from cooling of heated and filled contents is prevented by a seal surface stretchable inside the bottle by means of the bellows.

BEST MODE FOR CARRYING OUT THE INVENTION

Figure 1:
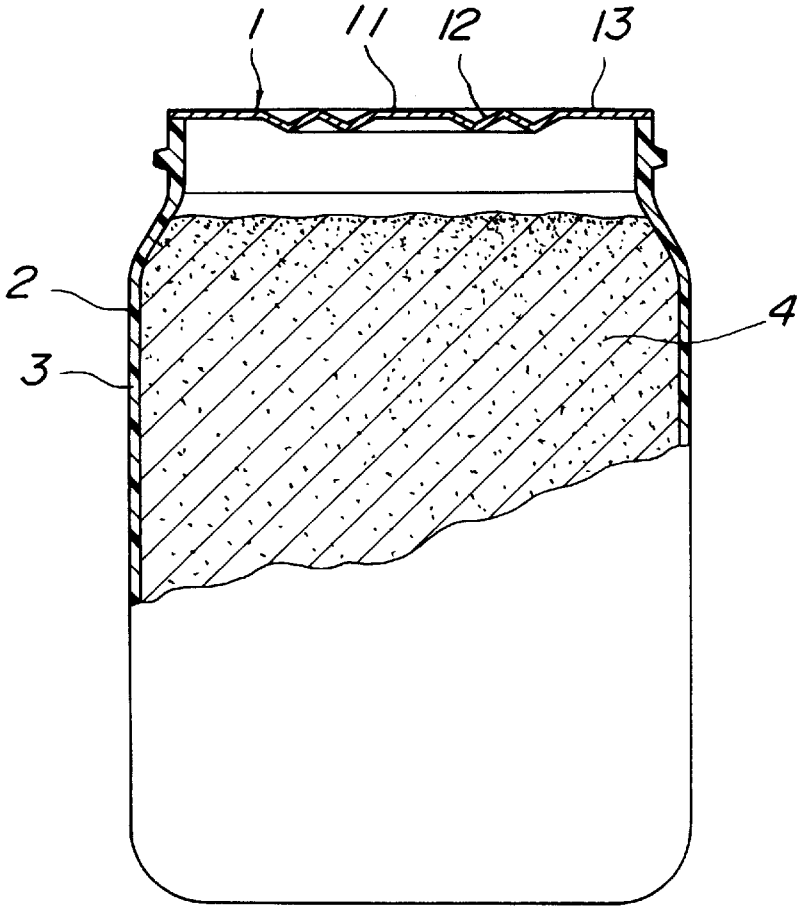
FIG. 1 is a longitudinal sectional view showing a main portion of a wide-mouthed bottle with a hermetic seal in accordance with the present invention.

Reference numeral 1 in the Figs. indicates a hermetic seal in accordance with the present invention, comprised of a sheet constituted of an aluminum sheet or an aluminum foil to which a synthetic resin film is laminated. A sheet for use in this invention is not limited to this sheet. Reference numeral 2 indicates a wide-mouthed bottle a body portion 3 of which is made thin. The wide-mouthed bottle is constituted of synthetic resin such as PET (polyethylene terephthalate), a blend of PET and PEN (polyethylene naphthalate), and is formed by stretch blow molding of an injection molded preform with a bottom.

The above mentioned seal 1 is formed in such a manner that the above mentioned sheet having a thickness of about 0.1 mm and expandability to some extent is punched into the same shape as a mouth of the wide-mouthed bottle 2 with a diameter of about 650 mm; and a seal surface 11 thereof is formed into a flat peripheral portion and a stretchable portion inside the flat portion by press molding concurrently with the punching. The peripheral portion is made to be flat, that is, it is not processed in order not to cause incomplete bonding when the seal is bonded to the mouth of the wide-mouthed bottle, even if the stretchable portion formed inside the peripheral portion was eccentrically formed. A concentrical bellows 12 as shown in FIG. 1 can be mentioned as a stretchable portion. The bellows 12 is formed to have mountain and valley portions folded quadruply in such a manner that an interval between the mountain portion and the valley portion adjacent thereto is from about 4 mm to about 6 mm and a difference in height between the mountain portion and the valley portion is from about 1 mm to about 1.5 mm. In this case, the interval, difference in height and number of folding should be determined as necessary depending on a diameter of the mouth of the bottle, and are not limited to the above mentioned numerical values. The seal 1 formed in this way is attached to a rim of the mouth by bonding a peripheral surface of the seal to the rim using pressure sensitive adhesive, hot-melt, or the equivalent.

The stretchable portion of the bellows 12 in the seal 1 like this is forcibly expanded by press molding. As a result, the stretchable portion is in a state of being apt to be stretched and deformed spherically to one side as compared with the peripheral portion 13.

If the mouth of the bottle is sealed by the seal 1 immediately after the wide-mouthed bottle 2 is filled with heated contents 4 with viscosity such as jam and the like; and then the wide-mouthed bottle 2 is left, a pressure inside the bottle is reduced resulting from the reduction of volumetric expansion of heated water content contained in the contents 4 as the contents 4 is cooling down.

By the way, a coefficient of volumetric expansion of water is $1.8\times10^{-4}$. When for example the contents 4 containing 100 cc of water content which is filled at a heated/filling temperature of 90° C. is cooled down to a room temperature (20° C.), 1.26 cc of volume $(100\times(90-20)\times1.8\times10^{-4}=1.26)$ is reduced resulting in the reduction of pressure in the bottle by the same amount. A, a seal surface 11 of the above mentioned seal 1 is pulled inside the bottle as a result of the reduced pressure by cooling.

Figure 2:
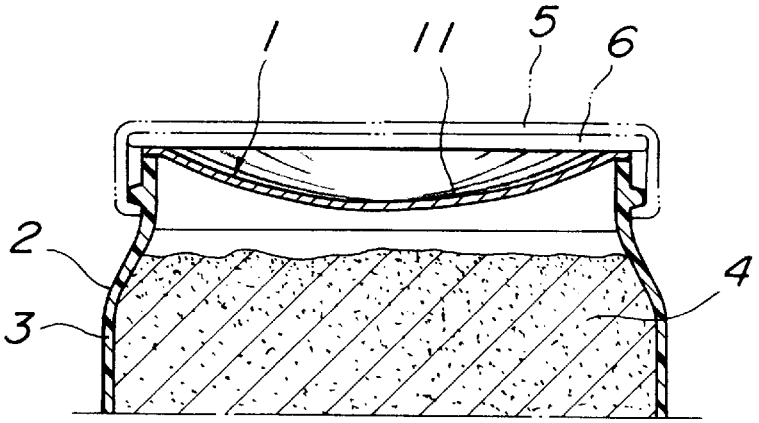
FIG. 2 is a longitudinal sectional view showing an upper portion of the wide-mouthed bottle in a stretched state of the hermetic seal resulting from a reduced pressure in the bottle in accordance with the present invention.
Figure 3:
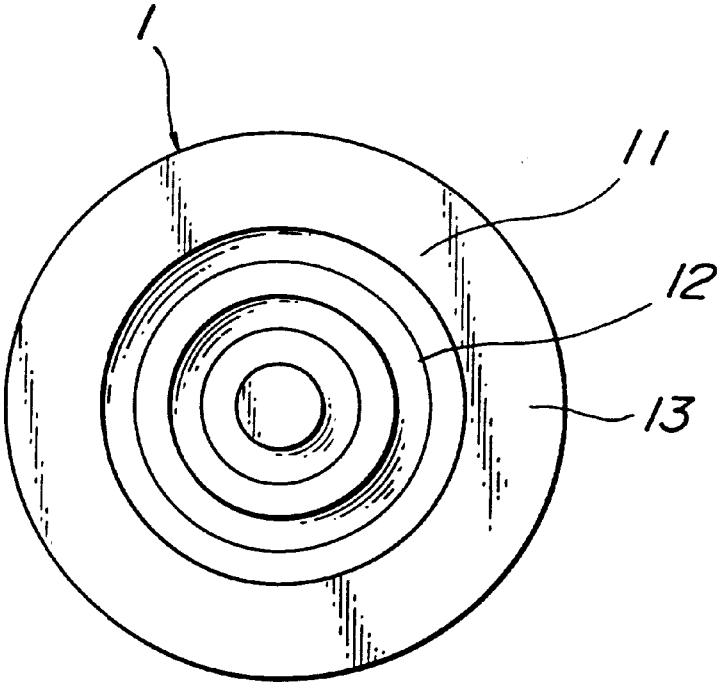
FIG. 3 is a plan view showing an embodiment of the hermetic seal of the present invention.
Figure 4:
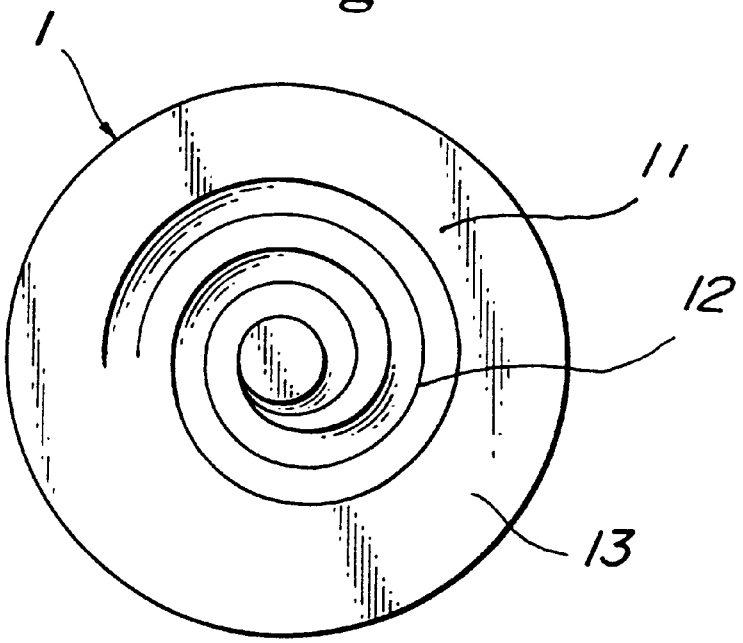
FIG. 4 is a plan view showing a second embodiment of the hermetic seal of the present invention.

Because the seal itself has expandability to some extent, the seal will be stretched spherically inside the bottle by tensile stress resulting from the reduced pressure. This stretching, however, is extremely slight and is not enough to prevent the deformation of the body portion 3 caused by a reduced pressure. In the seal 1, however, in addition to the expandability which the seal itself has, the seal surface 11 thereof as shown in FIG. 2 can stretch spherically inside the bottle to a greater extent by means of the bellows 12 formed to be more stretchable by press molding. As a result, the deformation of the body portion 3 caused by the reduced pressure is prevented.

It is most preferable to attach a cap 5 after the contents 4 was cooled down to almost a room temperature so that the pressure inside the bottle could be hardly reduced. However, because it takes time to cool the contents, the cap 5 tends to be attached after the mouth of the bottle was sealed by the seal 1.

A packing 6 or a rubber ring (not shown) for hermetically sealing the mouth after taking off the above mentioned seal 1 is inserted inside the cap 5. By tightening the cap 5 to a peripheral of the mouth portion of the bottle by means of screws or fitting, the bottle is sealed by said packing 6 or the equivalent.

If the bottle is completely sealed by the cap 5 in the cooling process of the contents 4, air will not be allowed to flow into a space between the seal 1 sealing the mouth portion and the packing 6 because outside air is blocked. The seal 1, therefore, will not stretch after a pressure inside the bottle begins to decrease resulting from cooling. As a result, the deformation of the body portion 3 will be caused by a reduced pressure, and there is no effect on preventing the deformation caused by a reduced pressure by means of the seal 1. For this reason, it is preferable to attach the cap 5 by tightening it with tightening strength such that air for preventing a negative pressure can flow into the space between the seal 1 and the packing 6. At this time, even if air flows into the space, the content 4 is continuously blocked from outside air because inside of the bottle is sealed by the seal 1.

Moreover, although the stepped portion 12 in the seal 1 as shown in Figs. is formed concentrically, the shape may be spiral, or it may be in a state of alternate and parallel bending.

INDUSTRIAL APPLICABILITY

In this way, for the above mentioned reasons, the prevention of the deformation of the body portion 3 caused by a reduced pressure by means of stretching of the seal 1 is remarkably effective on the wide-mouthed bottle the panel surface formation of which is limited. In addition, because only sealing the mouth by the seal 1 is required, there is no possibility of having a complicated structure in particular. Furthermore, if the seal is applied to the wide-mouthed bottle with formed panel surfaces, the effect will be more enhanced in combination with the deformation provided by those panel surfaces.

What is claimed is:

1. A hermetic seal for a mouth of a wide-mouthed bottle formed by stretch blow molding, said seal comprising a flat peripheral portion having an upper surface facing away from the bottle and a stretchable portion inside the flat peripheral portion, wherein the stretchable portion has alternate multiple mountain and valley portions and ridges of the mountain portion are at the same level as the upper surface of the flat peripheral portion when the bottle is initially sealed by the seal, and wherein the flat peripheral portion has a width so as to prevent incomplete bonding between the seal and the mouth even when the stretchable portion is eccentrically formed therewithin.

2. The hermetic seal according to claim 1, wherein said seal is comprised of a laminated sheet constituted of an aluminum sheet or an aluminum foil as a base, and a synthetic resin film laminated on the base.

3. The hermetic seal according to claim 1, wherein said stretchable portion is comprised of a bellows having alternate multiple mountain and valley portions formed by bending.

4. The hermetic seal according to claim 3, wherein the bellows formed in said seal is in a concentrical state.

5. The hermetic seal according to claim 3, wherein the bellows formed in said seal is in a spiral state.

6. The hermetic seal according to claim 3, wherein a difference in height between the mountain portion and the valley portion of the bellows formed in said seal is from about 1 mm to about 1.5 mm.

7. The hermetic seal according to claim 3, wherein an interval between the mountain portion and the valley portion adjacent thereto of the bellows formed in said seal is from about 4 mm to about 6 mm.

8. A wide-mouthed bottle, a mouth of which is sealed by a hermetic seal; and a body portion of which is thinly formed by stretch blow molding; wherein said hermetic seal has bellows with alternate multiple mountain and valley portions formed by bending, and is formed into the same shape as the mouth of said wide-mouthed bottle; wherein the seal further comprises a flat peripheral portion for sealing the mouth, and ridges of said multiple mountain portions of the seal are at the same level as an upper surface of the flat peripheral portion when the bottle is initially sealed by the seal, while the deformation of the body portion caused by a reduced pressure inside the bottle resulting from cooling of the heated and filled contents is prevented by a seal surface stretchable into the bottle by means of said bellows.

9. The wide-mouthed bottle according to claim 8, wherein said seal is comprised of a laminated sheet constituted of an aluminum sheet or an aluminum foil as a base, and a synthetic resin film laminated on the base.

10. The wide-mouthed bottle according to claim 8, wherein the bellows formed in said seal is in a concentrical state.

11. The wide-mouthed bottle according to claim 8, wherein the bellows formed in said seal is in a spiral state.

12. The wide-mouthed bottle according to claim 8, wherein a difference in height between the mountain portion and the valley portion of the bellows formed in said seal is from about 1 mm to about 1.5 mm.

13. The wide-mouthed bottle according to claim 8, wherein an interval between the mountain portion and the valley portion adjacent thereto of the bellows formed in said seal is from about 4 mm to about 6 mm.

* * * * *